United States Patent [19]

Frye

[11] Patent Number: 4,685,408

[45] Date of Patent: Aug. 11, 1987

[54] CLOTH STITCHING APPARATUS AND METHOD

[76] Inventor: David E. Frye, 25464 Via Adorna, Valencia, Calif. 91355

[21] Appl. No.: 857,086

[22] Filed: Apr. 29, 1986

Related U.S. Application Data

[62] Division of Ser. No. 685,998, Dec. 24, 1984.

[51] Int. Cl.[4] ..... D05B 1/00; D05B 97/00

[52] U.S. Cl. ..... 112/262.3; 112/121.14; 112/308; 112/122; 112/288

[58] Field of Search ..... 112/262.3, 262.1, 121.14, 112/121.11, 121.12, 121.15, 308, 309, 122, 288

[56] References Cited

U.S. PATENT DOCUMENTS

| | | | |
|---|---|---|---|
| 3,580,198 | 5/1971 | Teed et al. | 112/121.11 |
| 3,640,235 | 2/1972 | Burton | 112/121.29 |
| 3,722,435 | 3/1973 | Elsas | 112/262.3 X |
| 3,773,002 | 11/1973 | Burton | 112/262.3 X |
| 4,296,696 | 10/1981 | Taddicken et al. | 112/121.14 X |
| 4,318,356 | 3/1982 | Beisler | 112/121.14 |

*Primary Examiner*—H. Hampton Hunter

*Attorney, Agent, or Firm*—Poms, Smith, Lande & Rose

[57] ABSTRACT

Cloth stitching apparatus and method for forming a rectangular cloth having stitched rounded corners, such as a wash cloth. Blank pieces of rectangular cloth material are aligned with an overlock sewing machine on the table of the apparatus. The sewing machine trims the cloth edges, folds over the trimmed edge and sews or stitches along one side of the cloth. Each piece of cloth is moved along X and Y axis. Thus, as the cloth is moving along an X axis at a predetermined surface speed, the sewing machine trims, and sews along one side of the cloth. When the cloth is moved along its X axis to a point where the sewing machine is adjacent a corner of the cloth, a switch is activated which starts turning the sewing machine. The cloth stops while the sewing machine turns at the same surface speed of the cloth on the actual radius of the corner of the cloth. The cloth then starts and goes in the opposite perpendicular direction Y while the sewing machine continues at the same surface speed. When the stitching around the outside edge of the cloth has been completed, the excess thread is sucked into the machine, cut off and the completed cloth is ejected.

3 Claims, 23 Drawing Figures

Fig. 5.
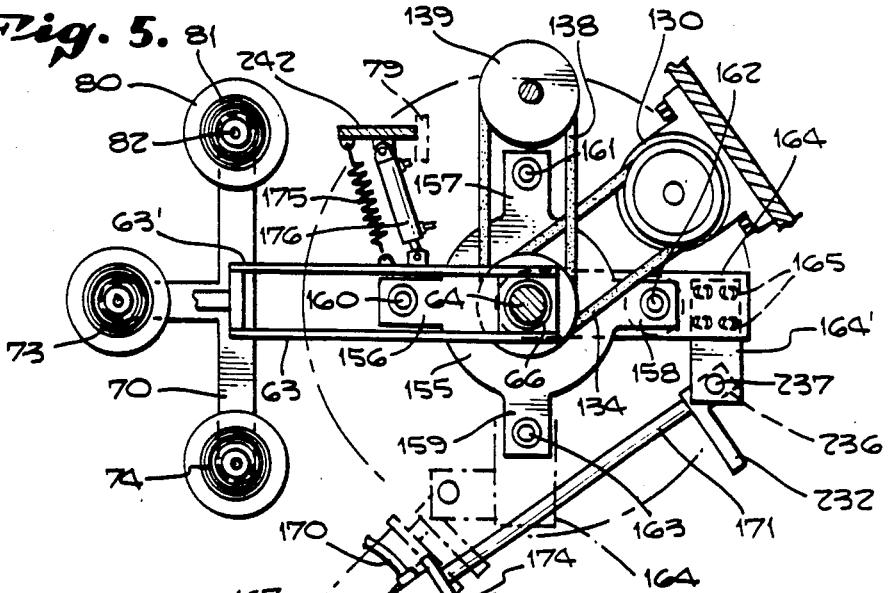
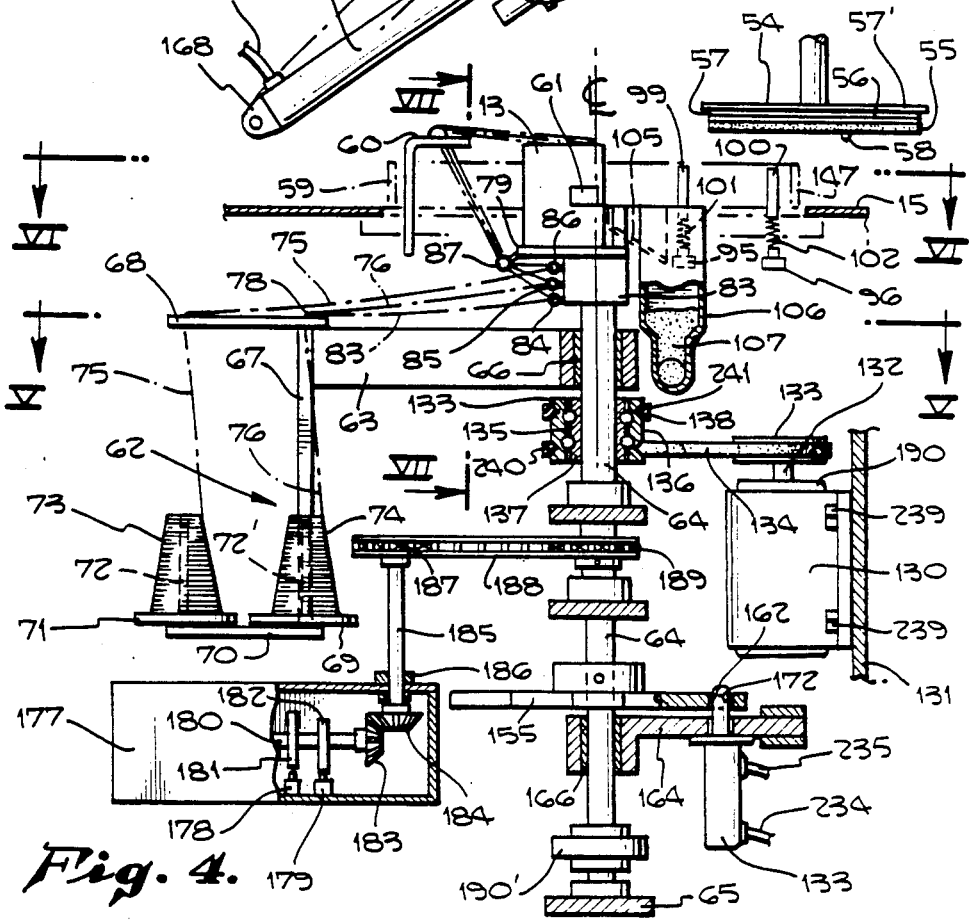
Fig. 4.

Fig. 6.
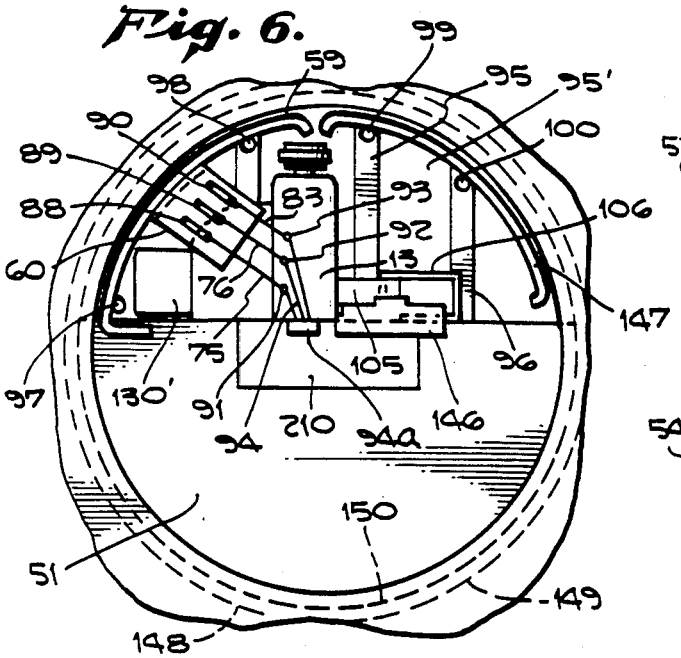
Fig. 11.
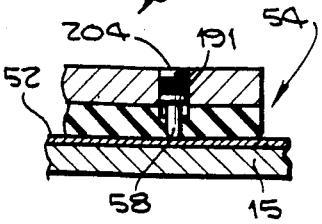
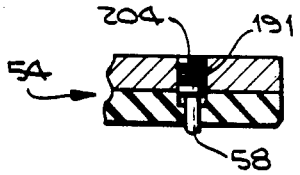
Fig. 10.
Fig. 7.
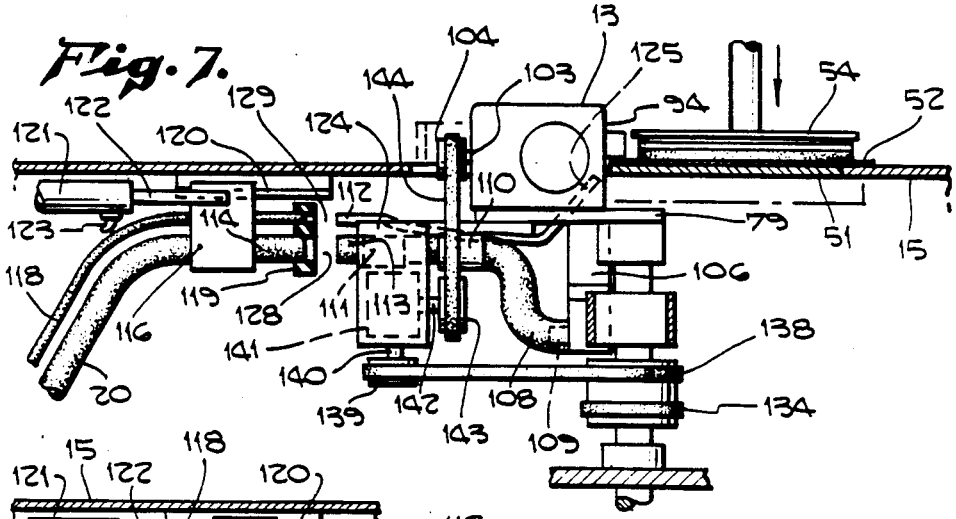
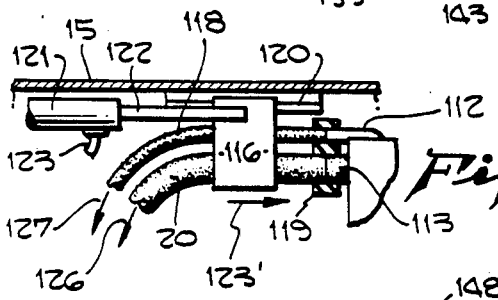
Fig. 8.
Fig. 9.
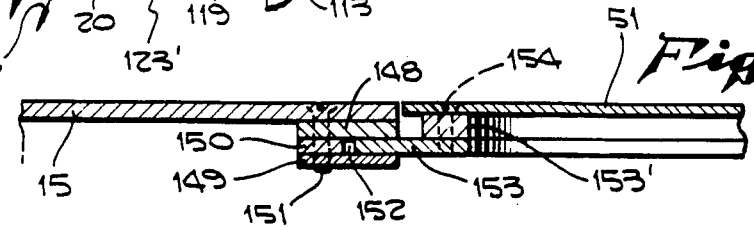

CLOTH STITCHING APPARATUS AND METHOD

This application is a division of application Ser. No. 685,998 filed Dec. 24, 1984.

BACKGROUND OF THE INVENTION

1. Field of the Invention

The invention relates to cloth forming apparatus and method; and, more particularly, to apparatus and method for quickly forming a plurality of rectangular cloths, such as wash cloths, having rounded corners and stitching along the entire peripheral edge.

2. Description of the Prior Art

In the manufacture of cloth products, such as napkins and washcloths that include folded hems, the products are usually manufactured by cutting a long length of cloth in smaller sections, and a sewing machine operator folds the edges over to form hems and sews around the four sides of the product. This prevents the hem from raveling and forms an attractive edge on the product.

Although many attempts have been made in an effort to automatically form hems in cloth lengths, only a few attempts have been considered commercially successful, and most of the attempts have failed where relatively small hems are to be formed in relatively bulky materials, such as the typically small hems in washcloths, towels and other objects fabricated from similar materials. As the hems get smaller and the thickness of the material increases, it is more difficult to automatically form the hem.

As illustrated in U.S. Pat. Nos. 3,640,235, 3,773,002, 3,722,435 and 3,580,198, various attempts have been made to automatically hem the edges of cloth sections. For example, U.S. Pat. No. 3,580,198 discloses a system which hems the opposite edges of a continuous length of cloth, cuts the length into sections, turns the length 90° as it continues to move in its rectilinear path, and then hems the opposite cut edges of the sections. U.S. Pat. Nos. 3,640,235 and 3,772,948 disclose systems which cut cloth sections from a continuous length of cloth, moves the cut lengths at a right angle with the cut edges parallel to the path of movement, hems one cut edge, and then flips the other cut edge over so that it can be hemmed by another "right-handed" sewing machine. U.S. Pat. No. 3,722,435 also discloses a right angle system but which utilizes a turning drum and conveyor tapes for turning the cloth sections over so that "right-handed" sewing machines can be used to hem the opposite cut edges of the cloth sections.

In addition to the cloth handling and guidance systems described in the preceding patents, various attempts have been made to control the movement of a folded hem and the body of a cloth section as the edge portion of the cloth section is folded over and sewn closed. For example, U.S Pat. No. 3,906,878 discloses a system in which a double fold is formed in the edge portion of a cloth section and the velocity of the folded portion as it approaches the sewing machine is controlled so as to prevent a "dog ear" or "hangout" from occurring in the hem of the cloth section.

In U.S. Pat. No. 4,296,696, FIG. 1 shows a sewing machine having a movable work holder (eg, for a cloth) and a sewing machine head that can rotate. This patent is primarily directed to sewing button holes and merely holds the cloth while being stitched and moves the sewing machine in a direction opposite the first seam to form the second seam (see Col. 2, lines 20 to 35).

None of these prior art apparatuses can quickly and easily form a plurality of cloths having hems and stitching along the hemmed areas.

SUMMARY OF THE INVENTION

It is an object of this invention to provide improved apparatus and method for making a plurality of cloths having rounded corners and stitching along the entire peripheral edge.

It is a further object of this invention to provide such apparatus which keeps the sewing thread from twisting and cuts off the thread used to form the stitched hem prior to ejection of the finished cloth.

It is still another object of this invention to provide such apparatus which removes cloth scrap and the like formed during the cloth sewing and trimming operation.

It is still another object of this invention to provide such apparatus which utilizes a conventional overlock sewing machine in the stitching operation.

It is further an object of this invention to provide such apparatus which sews in a label at one corner of the cloth during the cloth forming process.

It is another object of this invention to feed thread into the sewing machine in an improved manner.

These and other objects are preferably accomplished by providing apparatus using an overlock sewing machine to manufacture a rectangular cloth with rounded 90° corners, such as a wash cloth. The apparatus includes the sewing machine operating at a continuously fast rate of speed without stopping at the corners. The outside edge of the rectangular cloth to be sewn is firmly held in the apparatus and guided by a clamp that stays on the cloth until the entire hemmed edge around the cloth has been completed. As the sewing machine completes its first hemmed side and comes to the corner, the sewing machine and part of the work table rotate. The axis on which the sewing machine turns is positioned in such a manner to create the arc of the corner as the machine turns. The turning apparatus allows the sewing machine to operate at the same fast speed that it did on the straight-of-way.

The sewing machine and rotary work table continuously turn in 90° increments in a clockwise direction. To keep the threads from twisting as the machine turns, the thread stand and thread follow the sewing machine and table around. To keep the turning apparatus from being too heavy, the thread stand is independent of the turning apparatus.

In order to keep the weight down and to allow for continuous rotation, the sewing machine and motor do not turn with the rotary apparatus. Instead, the power is transferred to the sewing machine by a series of belts and pulleys.

BRIEF DESCRIPTION OF THE DRAWING

FIG. 4 is a view taken along lines IV—IV of FIG. 3;

FIGS. 5 to 7 are views taken along lines V—V, VI—VI and VII—VII respectively, of FIG. 4;

FIG. 8 is a vertical view of a portion of FIG. 7 showing another step in the operation thereof;

FIG. 9 is a view taken along lines IX—IX of FIG. 6;

FIGS. 10 and 11 are cross-sectional views of a portion of the apparatus of FIG. 7 showing two positions of operation thereof;

DESCRIPTION OF THE PREFERRED EMBODIMENT

Figure 1:
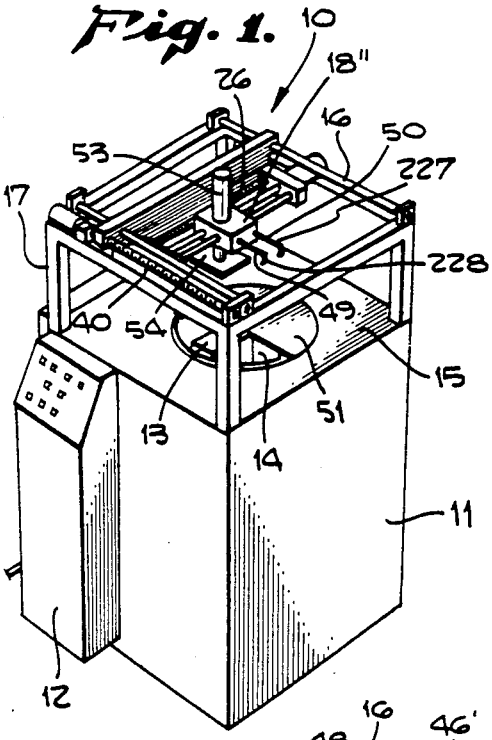
FIG. 1 is a perspective view of cloth forming apparatus in accordance with the teachings of the invention.
Figure 3:
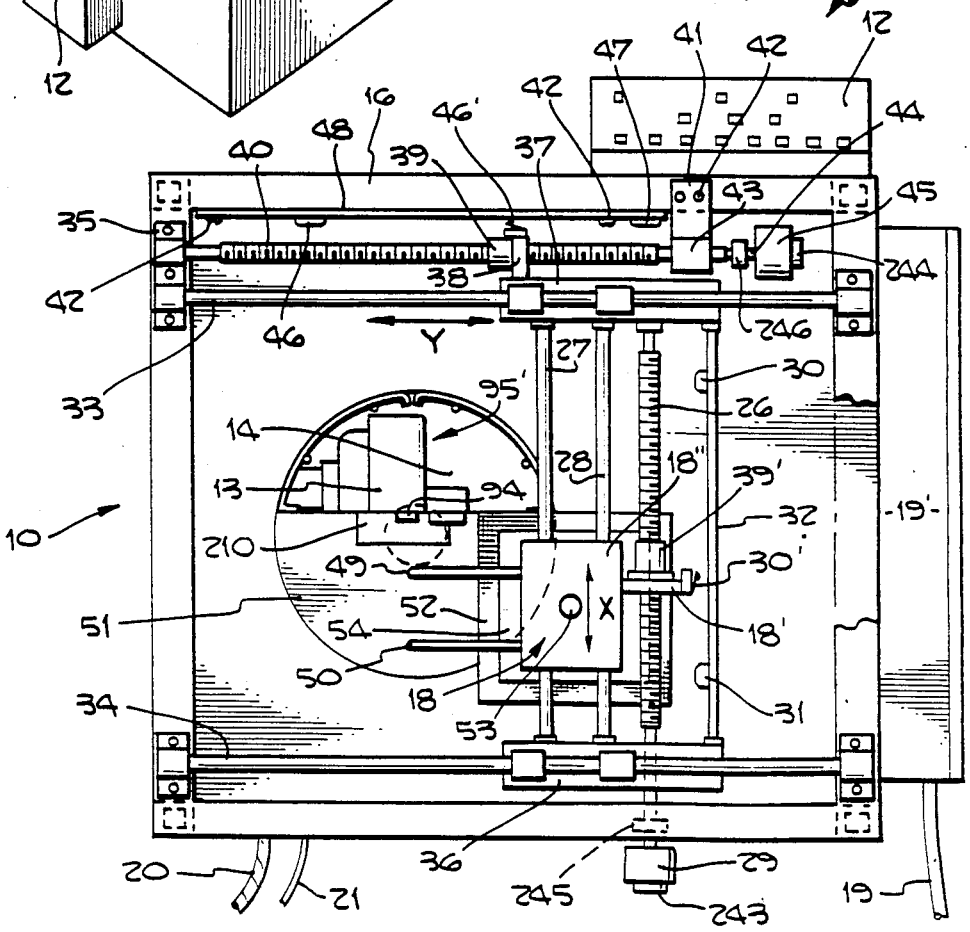
FIG. 3 is a top plan view of the apparatus of FIG. 1.

Referring now to FIG. 1 of the drawing, cloth forming apparatus 10 is shown having a main housing 11, a control panel 12, a conventional overlock sewing machine 13 mounted in an opening 14 in the top wall 15. As will be discussed, a conventional presser foot and needle plate 210 are provided at sewing machine 13 (FIGS. 3, 6 and others).

As seen in FIG. 4, and as heretofore discussed, guide plate 54 is comprised of a first bottom layer 55 of a suitable cushioning material which has a gripping action on the cloth. Cushioning layer 55 is glued to the top metallic plate 56. A one inch wide ring of insulating material 57 lays on top and around the outside edge of plate 56. Metallic ring 57′ lays on top of the insulating ring 57. Metallic ring 57′ protrudes out $\frac{1}{8}$″ around the entire outside edge of the guide plate 54. A wire from a "Machine Stop" relay in the control panel 12 is connected to ring 57′. If guide plate 54 should contact any metal during its cycle, the metallic ring 57′ touches first completing a circuit to the ground side of the stop relay. This causes motor 130 to immediately shut down and the large turn cylinder 167 goes into a neutral position and all pressure is released. This acts as a back up protection in case the turn combination protector, which may be electronically provided in the control panel 12 to sense the proper orientation of the apparatus along its X and Y axes in relation to the position of the sewing machine, does not operate correctly. This also protects the guide plate 54 from being smashed or damaged in case sewing machine 13 turns out of synch.

Frame 16 is generally rectangular (as in top wall 15) and includes four spaced legs 17 mounted in any suitable manner at each corner of top wall 15. The frame 16 also includes finished cloth removing apparatus, as will be discussed, as electrical conduit 19 leads to a power source 19′ coupled to panel 12 providing a suitable source of current, and vacuum hoses 20, 21, for reasons to be discussed, extend to apparatus 10.

Figure 2:
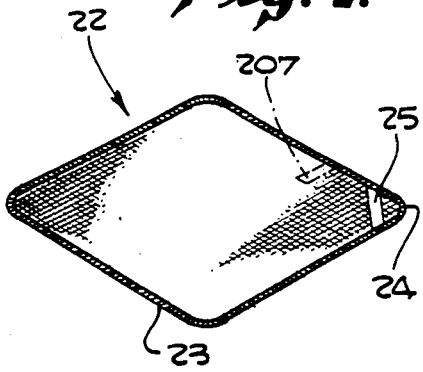
FIG. 2 is a perspective view of a completed cloth in accordance with the invention.

Apparatus 10 of FIG. 1 is used to form a cloth having hemmed and sewn edges with rounded corners. A finished cloth 22 is thus generally rectangular in shape having a hemmed sewn peripheral edge 23 with rounded corners 24 and a label 25 stitched at one corner 24, (FIG. 2).

As seen particularly in FIG. 3, the cloth guiding apparatus 18 travels along a threaded screw shaft 26 and guide rods 27, 28. Shaft 26 has a conventional ball nut, 39′ threadably coupled thereto and coupled to bracket 18′. Thus, when motor 29 rotates screw shaft 26, ball 39′ moves bracket 18′ (see FIG. 1) along the X axis. Limit switches 30′ are attached to bracket 18′. One or more spaced conventional trip dogs, such as dogs 30, 31, may be provided at spaced locations along a trip rail 32 extending between spaced cross rods 33, 34.

These cross rods 33, 34 extend transverse to rods 27, 28. Blocks 36, 37 are movable along guide rods 33, 34 in the direction of arrow Y. Rods 27, 28, shaft 26 and trip rail 32 are all connected to blocks 36, 37 at their free ends so that, as blocks 36, 37 move along rods 33, 34, apparatus 18 also moves.

One of the blocks, such as block 37, is coupled via bracket 38 to a conventional ball nut 39 threaded on threaded screw shaft 40 extending parallel to rod 33 and spaced therefrom also secured at one end to frame 16 by a bracket 35 and at the other end to a bracket 41. Bracket 41 is secured, via screws 42, to frame 16 and includes a bearing member 43 receiving therein the shaft 44 of a motor 45. Shaft 44 is coupled to shaft 40 so that, when motor 45 is actuated, shaft 40 rotates and thus block 37 is moved therealong in the direction of arrow Y. Trip dogs, such as trip dogs 46, 47, are provided on trip rail 48 secured to frame 16 by screws 42, at predetermined locations. Trip dogs 46, are of course located in the path of movement of bracket 38 which has limit switches 46′ mounted to it such that the extent of movement thereof (and, thus movement of block 37) can be controlled as is well known in the material handling art and as will be described further.

A pair of spaced hollow air tubes 49, 50 (see also FIG. 1) form part of apparatus 18 extending outwardly over the turntable 51 (see also FIG. 1) mounted over opening 14. As seen in FIG. 1, each tube 49, 50 curves back toward the left side of the apparatus of FIG. 1 for reasons to be discussed.

A cloth blank 52 of rectangular shape is shown below apparatus 18 in FIG. 3 prior to hemming and stitching of the same. As seen in FIG. 1, a conventional air cylinder 53 extends downwardly through a block 18′ to pressure guide plate 54 (see also FIGS. 3 and 4) which is carried at the lower end of the rod of cylinder 53. This plate 54 serves to retain the cloth material blank 52 in position for sewing and hemming and also moves it into such position as will be discussed. Finally, a pneumatic air valve chamber may be provided having suitable air inlets and outlets for providing pressurized air in the system as will be discussed, such as to cylinder 53 via suitable inlets and outlets.

As seen in FIG. 4, plate 54 is comprised of a first bottom layer 55 of a suitable cushioning material, a metallic plate 56, and a top metallic ring 57′. A ring 57 of insulating material separates ring 57′ from plate 56. A metallic sensing button 58, such as brass, is provided on layer 56, coupled via suitable means not shown, to the control panel 12 and apparatus therein. It is to be understood that if button 58 contacts the top wall 15, which is of metallic material, and no cloth is present, a circuit will be completed between wall 15 and button 58 which, in turn, signals control panel 12 and deactivates the various motors as heretofore and hereafter described.

Sewing machine 13 includes a conventional thread cutting blade or knife 61 mounted thereon. A thread stand 62 is mounted within housing 11 below top wall 15. Thread stand 62 includes a cross-member 63 extending to an upright drive shaft 64 which extends upwardly from the base plate or from a bottom bracket 65 on housing 11. A bearing member 66 between member 63 and shaft 64 allows shaft 64 to rotate as will be discussed.

Thread stand 62 further includes a vertical bar 67 extending from thread guide 68 mounted to and extending from the upper surface of braces 63 and 63' (FIG. 5). Bar 67 is mounted to plate 69 mounted on a cross-brace 70. A plate 71 similar to plate 69 is also mounted on brace 70 and includes a rod 72 upstanding therefrom. Spools 73, 74, containing thread thereon, are spindled on rods 72, 72', respectively. Threads 75, from spool 73, extends through an opening mounted in plate 68 and thread 76 from spool 74 extends through an opening 78 in plate 68. As seen in FIG. 5, a plate 80, similar to plates 69 and 71, is mounted on brace 70 and a spool 81, similar to spools 73, 74 is spindled on a rod 82 extending upwardly from plate 80.

The bottom of sewing machine 13 is mounted on a plate 79 fixed to a socket member 83 fixed to shaft 64 for rotation therewith. A plurality of eyelets, such as eyelets 84 to 86, are mounted to socket member 83. Thread 76 passes through eyelet 85, thread 83' passes through eyelet 84 and thread 75 passes through eyelet 86. The threads 76, 83' and 75 then pass through an eyelet 87 mounted on plate 79 and up through conventional broken thread detectors 88 to 90 (FIG. 6) mounted on bracket 60 to sewing machine 13 as is well known in the art. Of course, any suitable placement of spools 73, 74 and 80, and passing of thread therefrom to sewing machine 13, may be used.

As seen in FIG. 6, threads 75, 76 and 83' pass through guides or eyelets 91 to 93, respectively, to the head 94 of sewing machine 13 as is well known in the art.

When a thread breaks, it will be detected by one of the broken thread detectors 88 to 90 by completing a circuit to one of the stop relays in control panel 12. The thread detector (88, 89 or 90) is well known in the art and any suitable detector may be used.

In FIG. 6, rail 59, and rail 147 spaced therefrom, are only provided in the space 95' of opening 14 in which sewing machine 13 is disposed. A plurality of spaced cross braces, such as braces 95, 96 (FIG. 6) extend across housing 11 below each rail 59, 147 and are attached to the plate 79 (FIG. 7) of the sewing machine assembly. One or more upstanding sensor rods, such as spaced metallic rods 97, 98 (FIG. 6) welded to or otherwise secured to rail 19 and spaced rods 99, 100 (FIG. 6) welded to or otherwise secured to rail 147, are provided. At their bottom ends, each rod 97 to 100 is resiliently mounted to its respective cross brace, such as by springs. For example, in FIG. 4, a spring 101 is mounted between rod 99 and brace 95 and a like spring 102 is mounted between rod 100 and brace 96. It is to be understood that rails 59 and 147 are adapted to complete a circuit when contact is made with metallic ring 57' of guide plate 54 (FIG. 4) and thus signal panel 12 to shut down the various motors heretofore and hereafter described.

The sewing machine head 94 is operated by a shaft 103 coupled to a pulley 104 having a belt 144 driving pulley 104 (see also FIG. 7), as will be discussed further. A ramp 105 (FIGS. 4 and 6) extends downwardly from sewing machine 13 leading to a cuttings tray 106 mounted on the undersurface of turntable 51. This tray 106 is adapted to receive cut off scraps of thread and material 107 therein. As seen in both FIGS. 4 and 7, a hose 108 is coupled at end 109 (FIG. 4) to tray 106 in communication with the interior thereof and extends through spaced collars 110 and 111 mounted on the underside of bracket 124, as seen in FIG. 7. As also seen in FIG. 7, the end 113 of hose 108 terminates before the end 114 of vacuum hose 20. Hose 20 passes through a collar 116 movably mounted on a bracket or guideway 120 and is fixedly secured thereto. Hose 20 is a vacuum hose and extends out of housing 11, as seen in FIG. 3, to a suitable source for creating a vacuum in hose 20. A vacuum pipe 118 also extends through collar 116, both pipe 118 and hose 20 terminating in a resilient grommet 119. As seen in FIG. 7, spaces 128, 129 are provided between the terminal open ends of pipe 118 and hose 20, respectively, and the outer face of grommet 119. An air cylinder 121 is provided on the underside of top wall 15 having a piston rod 122 fixedly secured to collar 116; an air line 123 is in fluid communication with the interior of cylinder 121 and extends to a suitable source of air for selectively admitting and removing air from cylinder 121 and thus actuating the same. An air pipe 112 is also mounted on bracket 124 extending to sewing machine 13 angled upwardly at end 125. Thus, as seen in FIG. 8, when cylinder 121 is activated, piston rod 122 moves to the right in FIG. 7 thus moving collar 116 along guideway 120 in the direction of arrow l23' in FIG. 8 to the FIG. 8 position thereby bringing grommet 119 up against end 113 of hose 108 and pipe 112 as seen in FIG. 8 with end 113 and pipe 112 entering spaces 128 and 129 and forming a seal providing fluid communication. In this manner, when a vacuum is created in pipe 118 and hose 20, the waste material 107 is sucked out of tray 106 through hose 20 as indicated by arrow 126. Also, any thread cuttings at head 94 of sewing machine 13 are removed via vacuum pipes 112 and 118 as indicated by arrow 127. Of course, deactivation of cylinder 121 returns the grommet 119 to the FIG. 7 position.

Referring again to FIG. 4, a motor 130 and clutch 190 is shown mounted to wall portion 131, which may be a side wall of housing 11, and has a clutch shaft 132 driving a pulley 133. A belt 134 encircles pulley 133 and extends to a bearing member 135. Main shaft passes through bearing member 135 and the outer race 136 rotates about the inner portion 137. A belt 138 (see also FIG. 7) encircles race 136 above belt 134 and extends to and encircles a pulley 139 coupled to shaft 140. Shaft 140 extends to a gear box 141 having gears therein driving shaft 142. Shaft 142 is in turn coupled to a pulley 143 having belt 144 thereon coupling pulley 143 to pulley 104.

Referring to FIGS. 4, 6 and 7, ramp 105 leads into aforementioned cuttings tray 106 (see also FIG. 4). An extended presser foot 146 is provided on turntable 51 adjacent head 94. As seen in FIG. 9, top wall 15 is provided with annular spaced braces or guide rings 148, 149 separated by a spacer 150 secured to wall 15 by rivets or screws 151. An annular space 152 is thus formed between ring 148 and 149 receiving therein an extension portion or flange 153 extending from and secured to turntable 51 by screws 154 passing through spacer 153' provided between turntable 51 and flange 153. In this manner, a guide is provided for the turntable so that it is both supported and guided as it journals within apparatus 10.

As seen in FIG. 5, a turn wheel 155 is secured to main shaft 64 (see also FIG. 4) having four spaced arms 156 through 159 with pin holes 160 through 163 in each respective arm 156 through 159. An extension arm 164 is bolted, via bolts 165, to cross brace 164' and journalled on shaft 64 via bearing 166 (FIG. 4). A pneumatic cylinder 167 (FIG. 5) is provided pivotally connected at one end 168 to housing 11 and having a suitable source of air pressure such as inlet and outlets 169 and 170 coupled thereto. The rod 171 of cylinder 167 extends to cross brace 164' which is connected to arm 164. Arm 164 carries a pin 172 (see particularly FIG. 4) thereon extending into hole 162 (in FIG. 5). A shock absorber 173 is provided on a bracket 174 fixed to cylinder 167. As seen in FIG. 4, a cylinder 133 is coupled to pin 172 actuated by air inlet 234 and air outlet 235 for reasons to be discussed.

Plate 79 (a portion thereof shown in FIG. 5) is resiliently coupled to brace 63' by a spring 175. A cylinder 176 is also pivotally coupled between plate 79 and cross brace 63'. A like cross brace 63 extends parallel to brace 63'.

A timing box 177 (FIG. 4) is provided in housing 11 having a plurality of timing switches, such as switches 178, 179, mounted therein. A rotatable shaft 180 is mounted within box 177 having cams 181, 182 mounted on shaft 180 for rotation therewith. A gear 183 is fixedly secured at one end to shaft 180 meshing with a gear 184 fixed to a shaft 185 extending from box 177 and rotatable therethrough at bearing member 186. Shaft 185 is fixed to a sprocket gear 187 driven by a chain 188 engaging a sprocket gear 189 mounted on shaft 64. A clutch 190' is also mounted on shaft 64 below turn wheel 155.

As seen in FIG. 10, plate 54 is shown in a first or "up" position, as in FIG. 4, above top wall 15 prior to contact with cloth 52 (FIG. 11). As button 58 engages cloth 52, it is pushed upwardly against the bias of spring 191 mounted in a chamber 204. As discussed heretofore, suitable electronic means (not shown) are coupled to button 58 to indicate when a cloth is not present between guide plate 54 and top wall 15 (FIG. 11).

Figure 12:
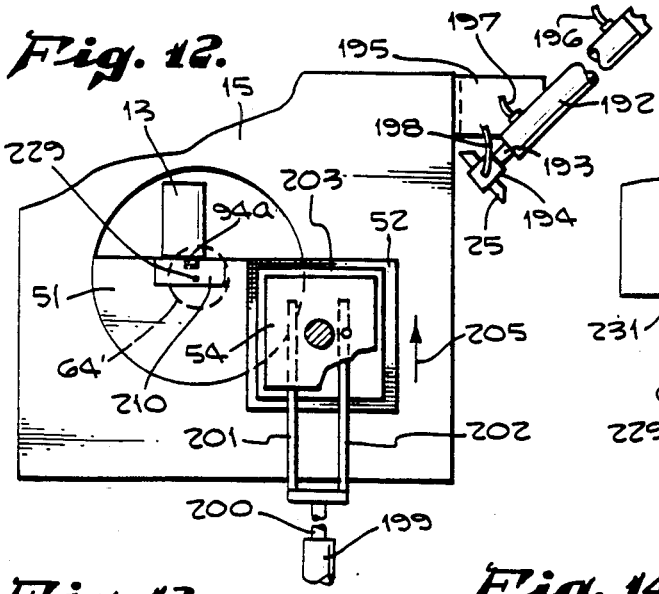
FIG. 12 is a plan view of a portion of the apparatus of FIG. 1 illustrating one feature thereof, with parts omitted for convenience of illustration.

As seen in FIG. 12, a pneumatic cylinder 192 having a piston rod 193 with a piston head 194 may be provided on a bracket 195 fixed to frame 16. An air inlet 196 and an air outlet 197 is provided leading to and out of cylinder 192 for activating piston rod 193. As also seen in FIG. 12, a label, such as label 25 in FIG. 2, is carried by head 194. The label 25 is sucked up by the suction caused by a suction tube 198 leading into head 194. Thus, the label 25 is momentarily held in position on head 194 and released when suction via tube 198 is released as will be discussed.

Although blanks of cloth material may be manually fed into the apparatus 10 of FIG. 1, as shown in FIG. 12, a pneumatically operated cloth feed apparatus may be provided having a conventional air cylinder 199 fixedly secured to the housing 11 at any suitable location having rod 200 carrying a frame in the form of spaced bars 201, 202. A plate 203 is carried by bars 201, 202 and overlies top wall 15 slightly spaced therefrom so that cloth 52 may be held between plate 203 and wall 15.

In order to sew a blank piece of cloth material in accordance with the invention, power to the machine is initiated by pushing a "Power On" button at control panel 12 (FIG. 1). This sends power throughout motor 130 and, a conventional chain cutter motor 130' (FIG. 6) which is part of the overlock sewing machine 12 as is well known in the art. After the power is on, then a "start" button is pushed at panel 12 and the sewing sequence begins.

Figure 14:
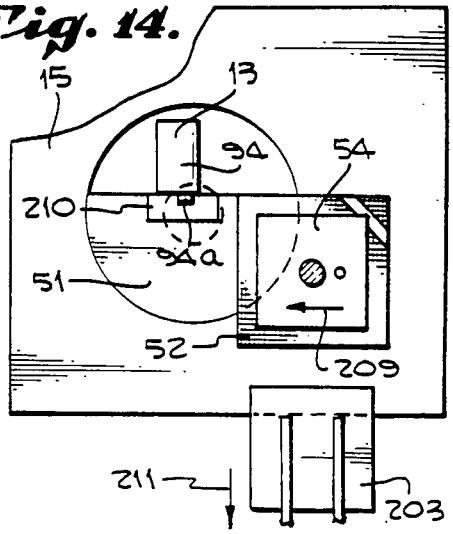

Transfer plate 203 (FIG. 12) is in the position shown in FIG. 14. Of course, pieces of cloth may be fed manually into the apparatus 10. Plate 203 presses down on cloth blank 52 to hold it against top wall 15. As plate 203 (FIG. 14) moves in the direction of arrow 205 (FIG. 12) to the FIG. 12 position, it trips a switch (not shown) during such movement. As plate 203 reaches the FIG. 12 position, it raises up and begins to move back to the position shown in FIG. 14 in the direction of arrow 211. The result of such movement of plate 203 deposits a piece of cloth material, such as cloth blank 52, in the FIG. 12 position. It is to be understood that cloth 52 is deposited under guide plate 54 (FIGS. 4 and 12).

Figure 13:
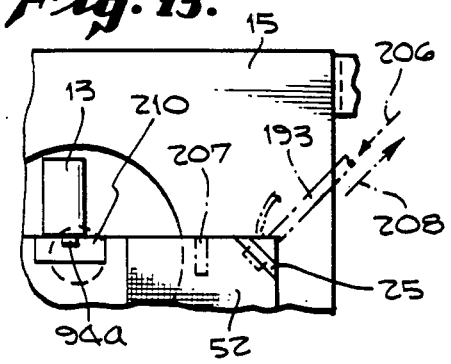
FIGS. 13 to 22 are plan views of portions of the apparatus of FIG. 1 illustrating the operation thereof.

When plate 203 is clear of guide plate 54 (FIG. 14), plate 203 trips another switch (not shown) and plate 54 drops down on top of cloth 52 to clamp or hold it in position on top wall 15 (see particularly FIG. 3, where cloth blank 52 is shown in position under plate 54, and, also FIG. 7). Prior to plate 54 dropping down and clamping blank 52, cylinder 192, holding a label 25 by suction at head 194, is activated to move from the position shown in FIG. 12 in the direction of arrow 206 (FIG. 13) to the position shown in FIG. 12 where suction is released on head 194 thus depositing label 25 in a corner position on cloth blank 52. Also, although label 25 is shown as deposited at the corner of cloth 52, as also shown in FIG. 13, a similar label 207, or label 25, may be deposited on blank 52 in the manner heretofore described. In either case, the label is loosely disposed on blank 52 and held in position by plate 54 when plate 54 moves to the FIG. 7 position. The label 25 is also in position to be stitched at its free ends when the edges of blank 52 are stitched while label 207 is in position to be stitched along one end thereof. The cylinder rod 193 is now retracted in the direction of arrow 208 to be out of the path of downward movement of plate 54 (FIG. 13).

Referring now to FIG. 3, when plate 54 reaches the down position of FIG. 7, a limit switch (not shown) on apparatus 18 is activated which activates the motor 45 and, thus, the assembly 18 and plate 54 begin to move along rods 33, 34 in the Y direction toward sewing machine 13. Of course, cloth 52 is also moved by plate 54. The surface speed of the movement of apparatus 18 and plate 54 is synchronized via suitable controls to the surface speed of sewing machine 13. The cloth 52 slides or is moved from the stationary top wall 15 to the rotary turntable 51 (FIG. 14) with very little friction since the rotating turntable 51 stays flush with the stationary top wall 15 (see FIG. 9).

As cloth 52 moves in the direction of arrow 209 in FIG. 14, and approaches the head 94 of sewing machine 13, switch 46' (FIG. 3) is tripped to activate the vacuum via pipe end 125 for the sewing machine chain cutter blade 61. Suitable timing means well known in the art may be provided for activating the vacuum for a predetermined period of time, such as one and one-half seconds.

The clutch 190 of motor 130 engages and the sewing machine 13 begins to operate. The cloth 52 passes over the foot plate 210 of sewing machine 13 which guides cloth 52 into engagement with the presser foot of sewing machine 13, all as is well known in the art.

At this time, blade **94*a* begins to cut off excess material from the edge of cloth 52 and drops the cutoff material via ramp 105 into the cuttings tray 106 (FIG. 4). Meanwhile, cloth 52 continues through the sewing machine 13 and is hemmed with an overlock stitch. As the leading edge of cloth 52 leaves the foot of the sewing machine 13, the excess sewing thread chain formed by threads 75–77 is sucked down the vacuum line via pipe end 125 and is cut off by the conventional chain cutter which is a part of the conventional overlock sewing machine being used. Meanwhile, blade 94*a*** cuts off excess material during the stitching process.

Figure 15:
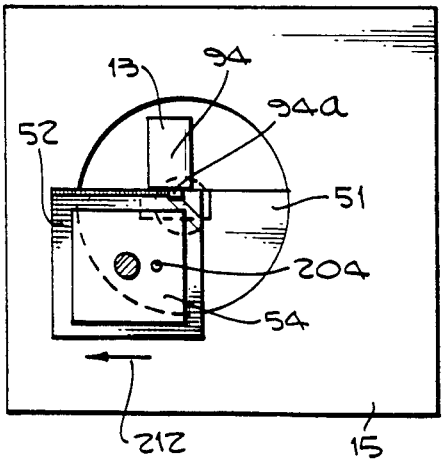

As the sewn cloth 52 moves in the direction of arrow 212 in FIG. 15, and the head 94 of sewing machine 13 approaches a point on cloth 52 just before the end corner thereof, as seen in FIG. 15, the motor actuating the sewing machine chain cutter blade 61 shuts off. This may be accomplished in any suitable manner, such as by one or more timing switches, such as switch 46' in FIG. 3, actuated during travel of the cloth 52. At the same time, vacuum line 20 and 118, in tne FIG. 8 position, are moved in the direction of arrows 126, 127 via actuation of cylinder 121, to the FIG. 7 position thus disconnecting the vacuum lines making way for rotation of turntable 51 (which, of course, cannot be rotated as long as the lines are engaged as in FIG. 8).

Figure 16:
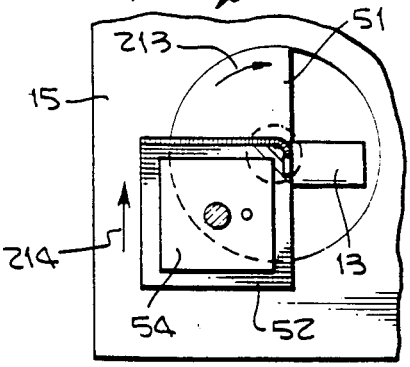

As cloth 52 moves in the direction of arrow 212 at a predetermined surface speed, such as speed s, and the corner thereof approaches head 94, the blade 94*a* becomes tangent to the arc of the corner. At this point, the movement of the plate 54 along the Y axis in FIG. 3 stops and the sewing machine 13 begins to rotate clockwise or in the direction of arrow 213 in FIG. 16 at the same surface speed s of cloth 52 until the 90° corner is sewn, as seen in FIG. 16. At this time, the cloth 52 is moved in the X direction (upwardly in FIG. 3 or in the direction of arrow 214 in FIG. 16). Sewing machine 13 is turned or rotated at a speed sufficient to maintain the same surface speed s of cloth 52.

Figure 18:
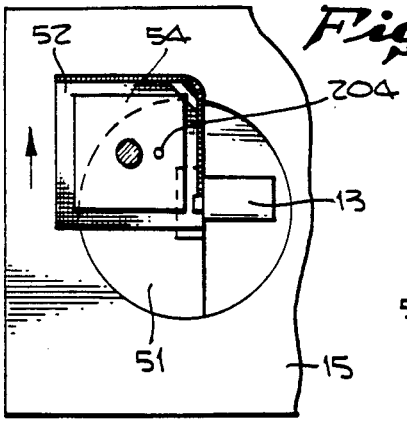
Figure 17:
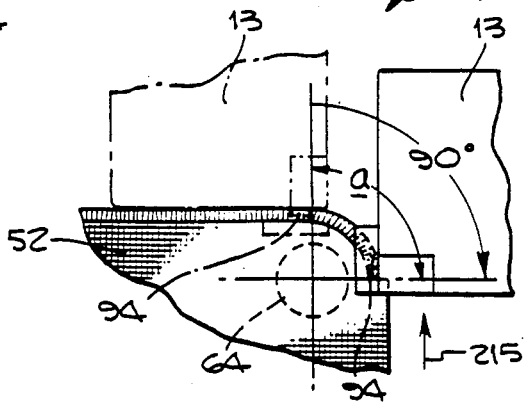

As seen in FIG. 17, the 90° angle is defined by arcuate stitching along area a which is formed by the machine 13 when the machine 13 rotates through the 90° arc. At this point, movement of cloth 52 along the X axis (FIG. 3) in the direction of arrow 215 in FIG. 17 begins and again at surface speed s. Movement of cloth 52 in the direction of arrow 215 continues until the next turn point or corner is reached and movement along the X axis is stopped (FIG. 18). A 90° turn of machine 13 is again made at surface speed s and, after such turn, cloth 52 is again moved in the direction of arrow 216 (FIG. 19) at speed s (or in the Y direction of FIG. 3) after the corner is sewn.

Figure 19:
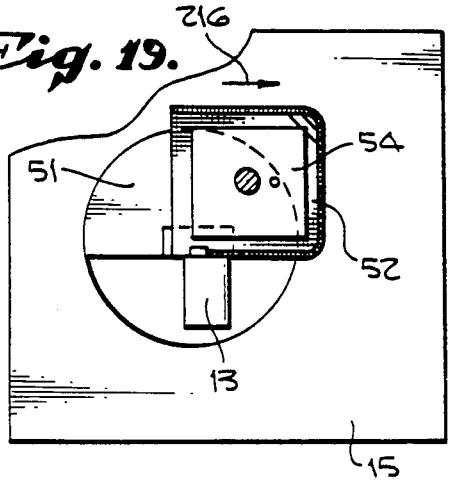
Figure 20:
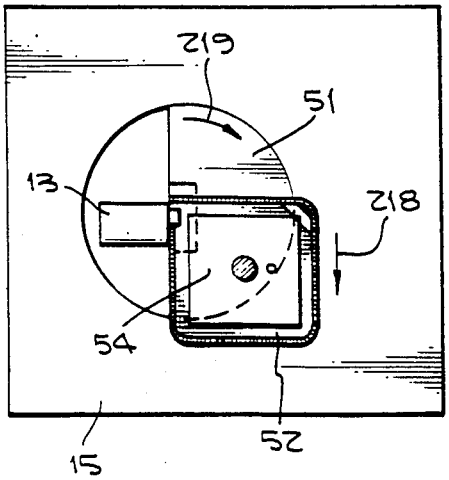

FIG. 19 shows the cloth 52 almost completely sewn. The cloth 52 is moved in the direction of arrow 216 until the corner is reached, movement is stopped, machine 13 rotates clockwise at the same surface speed s to form a corner as in FIG. 17, and the machine 13 now stitches along the last row as in FIG. 20 as the cloth 52 is moved in the direction of arrow 218. At the final corner, machine 13 is rotated in the direction of arrow 219 at speed s while movement of cloth 52 is stopped.

Figure 21:
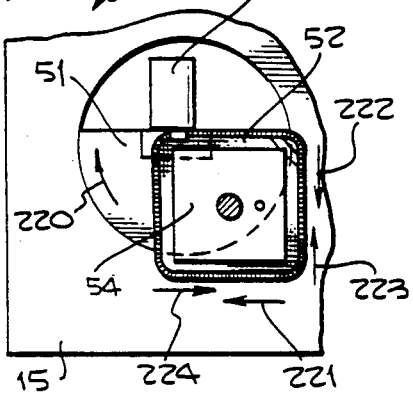
Figure 22:
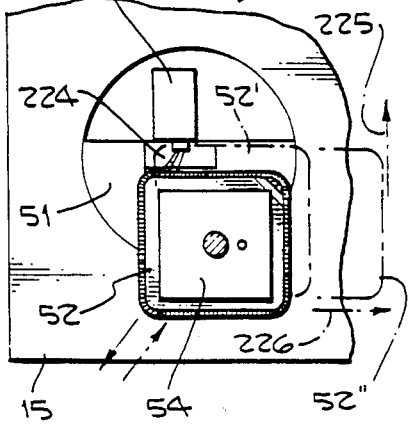

As soon as the last corner is sewn (FIG. 21) when machine 13 rotates clockwise in the direction of arrow 220, direction of travel of cloth 52 having been stopped, sewing machine 13 has finished its travel around the edge of cloth 52 and has sewn over or overlapped a portion of the initial stitching (left end of the stitching in FIG. 15) for a predetermined distance, such as approximately one-half inch. Also, as seen, the label 25 has been stitched in position on cloth 52. At this point, the presser foot of the sewing machine foot plate 210 lifts up, the plate 54 moves along the Y axis in FIG. 3, in the direction of arrow 221 in FIG. 21, then begins to move in the direction of arrow 222 in FIG. 21 or along the X axis. The scrap vacuum hose 108 and chain vacuum line 112 are interconnected as discussed hereinabove with respect to FIGS. 7 and 8, and the motor of the chain cutter blade 61 is started. When sewn cloth 52 has moved a predetermined distance along the X axis in the direction of arrow 222 in FIG. 21, such as one inch, movement of cloth 52 is stopped along both the X and Y axes and the direction of movement of cloth 52 is reversed. That is, it is moved in the reverse directions along the X and Y axes in the directions of arrows 223 and 224, respectively, in FIG. 21. When the direction of movement of cloth 52 is reversed, the threads slacken and the thread chain is sucked via vacuum in line 125 down into the chain cutter where the thread is cut off by the blade 61 close to the edge of cloth 52 and the cloth 52 is in the dotted line position 52' (FIG. 22).

When cloth 52 has travelled along the X axis for a predetermined distance, such as one inch, in the direction of arrow 225, movement is stopped and the vacuum hose 108 is activated to suck for a predetermined time, such as 2 seconds. Cloth 52 is now moved along the Y axis in the direction of arrow 226 until it reaches the dotted line position 52''. At this point, guide plate 54 is lifted.

Cloth 52 may of course be removed manually. Preferably, however, the final dotted line 52'' position in FIG. 22 is under the tubes 49, 50 in FIG. 1. Any suitable means may be provided for selectively injecting air into tubes 49, 50 so that the air exits out of the open ends thereof. These open ends 227, 228 (FIG. 1) open into the path of movement of the cloth 52 in the direction of arrow 226 (FIG. 22). Thus, a blast of air out of ends 227, 228 ejects the finished cloth 52 off of the surface 15 to a suitable collection bin (not shown).

At this time, plate 203 is actuated to bring another blank piece of material into sewing position as discussed hereinabove with respect to FIGS. 12 to 14. Another cycle of operation is then initiated.

It is also to be understood that conventional means may be associated with plate 203 to precut the pieces of material to a desired configuration, such as the rectangular shape shown, prior to being fed into apparatus 10. Also, any suitable control means may be used as is well known to those skilled in the art. Further, the various operations may be carried out mechanically, as by manually tripping switches, or electronically, as by the proper positioning of switches and timing devices, as is well known in the material handling art.

The 90° arc that is sewn around each corner of the cloth is created as the machine 13 rotates. The center axis of the drive shaft 64 (FIG. 4) is also the center of radius of the arcs sewn around each corner.

The length a (FIG. 17) of these arcs is determined by the radius of the arc. In order to sew the arc properly, the axis of shaft 64 (point 229 in FIGS. 12 and 23—dotted lines 64' indicating the position of shaft 64) must be on a line 230 even with the leading edge 94' of the cloth cutting blade 94*a* and perpendicular to edge 231 coincident with the cutting back edge 94'' of blade 94*a*. This allows the cloth 52 to be fed perfectly straight into the cutting edge 94'' of blade 94*a* parallel and even with line 231 as the sewing machine 13 is rotating.

In order to sew the corner a (FIGS. 17 and 23) properly without any change in the RPMS of machine 13, machine 13 is rotated at a speed that keeps the surface speed s on needle plate 210 the same as the surface speed of cloth 52 on the straight path movement along the X and Y axes. This is accomplished by turn cylinder 167 in FIG. 5.

Thus, referring back again to FIGS. 4 and 5, flow control means is used in conjunction with turn cylinder 167 to regulate the speed thereof so that the exact desired surface speed may be obtained for movement of cloth 52 along needle plate 210 which includes a conventional pressure foot thereon for guiding material therebetween. That is, machine 13 and turntable 51 must be rotated very quickly to maintain the same surface speed s of cloth 52 along its X and Y axes.

As seen in FIGS. 4 and 5, the turn sequence is carried out as follows. Cylinder 167 (FIG. 5) is shown in its solid line extended position. As particularly seen in FIG. 4, pin 172 is in the "up" position (see also FIG. 5). Turn cylinder 167 is retracted at a predetermined relatively fast rate of speed which retraction may be controlled in any suitable manner, such as fluid inlet and outlet 169, 170 coupled to suitable fluid control means (not shown). As the cylinder 167 retracts, it pulls the main shaft turn lever or arm 164 which pulls the main shaft turn wheel 155. Wheel 155 turns the main shaft 64 and thus the sewing machine 13 and rotary turntable 51.

As the turn cylinder 167 approaches the end of its stroke, the shock absorber stop 232 at the end of rod 171 (FIG. 5) makes contact with the shock. absorber 173 which slows down and stops the fast moving rotary assembly quickly without a sudden jolt. The turn pin 172 is now retracted via from turn wheel 155 and turn cylinder 167 is extended to the end of its stroke. Since the turn lever or arc 164 is connected to cylinder 167, the arm 164 moves back to its starting position in turn wheel 155 and turn pin 172 is now extended into the hole 162 in the turn wheel 155. This completes the 90° turn sequence. During the time that turn arm 164 is moving back to its starting position, the main shaft 64 is held in position by slip clutch 190'.

The holes 160–163 are precisely 90° apart and turn pin 172 must be in almost perfect alignment with the holes 160–163. Adjustment of this alignment may be made on turn lever or arm 164. Elongated holes 165' are provided in cross brace 164' to provide a lateral adjustment of cross brace 164' on arm 164. Thus, hole 237 may be moved closer to or further away from main shaft 64. When hole 237 is moved closer to the main shaft 64, the stroke of lever 164 becomes greater. When hole 237 is moved away from main shaft 64, the stroke of lever 164 becomes less.

The shaft 180 (FIG. 4) of timing box 177 is connected to main shaft 64 by chain 188 and sprocket 187 as heretofore discussed. Although only two cams 181, 182 are illustrated in box 177, obviously any desired number may be provided, such as twenty such cams.

As seen in FIG. 4, the sewing machine motor 130 is fixedly secured to the wall portion 131 via suitable nuts and bolts 239. Thus, motor 130 does not turn 360° with the rotation of the sewing machine 13. Motor 130 is too heavy to turn quickly with machine 13 and there would be no way to get electrical power to motor 130 if it rotated continuously clockwise with sewing machine 13. Thus, belt 134 and double grooved pulley 133, fastened to main shaft 64 by ball bearings, allows pulley 133 to spin freely on shaft 64. Power from motor 130 is transmitted through belt 134 to the lower groove 240 of pulley 133, and then from the upper groove 241 on pulley 133, via belt 138 (see also FIG. 5) to the pulley 139 (FIG. 7) and, thus, to sewing machine 13 as heretofore described. The arrangement herein allows the machine 13 to rotate continuously using a totally external power source that does not rotate with the machine 13. This of course solves the problem that would be encountered in attempting to spin or rotate an extremely heavy motor.

Thread stand 62 follows the sewing machine 13 around during its rotation. This keeps the threads from spools 73,74,81, from twisting and tangling and allows the sewing machine 13 to be supplied with thread as it continuously rotates. In order to prevent stand 62 from whipping around at a fast rate of speed, and also to eliminate the weight of stand 62 as a weight factor when machine 13 turns, stand 62 is not directly fastened to the sewing machine rotating assembly. Instead, stand 62 is connected by spring 175 and shock absorber 176 to the frame portion 242 of plate 79. When the quick turn of machine 13 is made, spring 175 extends and starts to pull. Shock absorber 176 also extends with no resistance. As the 90° turn is completed, spring 175 begins to pull the thread stand 62 (FIG. 4) toward frame portion 242. Stand 62 is attached to shaft 64 by bearing 66 via cross members 63—63'. As spring 175 pulls, shock absorber 176 begins to resist and, therefore, allows the thread stand 62 to return to its original position slowly and without disrupting the threads or making a sudden jolt against machine 13.

Guide plate 54 (FIG. 1) is moved up and down by the aforementioned air cylinder 53. As discussed heretofore with respect to FIG. 3, bracket 18, having cylinder 53 coupled thereto, is connected to the X carriage and the X carriage is connected, via blocks 36, 37, to the Y carriage. Thus, guide plate 54 moves along either the X axis or the Y axis, or a combination of both. Guide plate 54 holds the cloth 52 firmly in position (FIG. 3) while the cloth edge is being sewn. For optimum results, the outside edge of guide plate 54 should be as close as possible to the outside edge of the cloth blank 52; however, guide plate 54 must not touch sewing machine 13.

As seen in FIG. 4, the bottom peripheral edge 55 of plate 54 may be provided with a resilient border, such as rubber pad, for example, about ½" thick. This pad may have a rough surface on the side thereof adjacent cloth 52 which thus serves to hold the same in position when plate 54 slides the cloth from the stationary top wall 15 to the rotary turntable 51. Of course, as seen in FIG. 4 and heretofore described, layer 55 may be roughened and serve the same purpose. This also allows the turntable 51 to turn underneath the guide plate 54 and cloth 52 without distorting the cloth 52.

The spring loaded cloth detector button 58 (FIGS. 4, 10 and 11) may be of brass and, as shown, normally extends down below the bottom of guide plate 54 (FIG. 10). When the guide plate 54 drops down, as shown in FIG. 7, and there is no cloth present on top wall 15, an electrical circuit is completed between wall 15, button 58 and the electronic components coupled thereto, and motor 130 is stopped. If the cloth 52 is in the correct position when plate 54 drops down, no circuit is completed and the machine and motor 130 continue to operate.

As heretofore discussed, a regular or corner label, such as labels 207 and 25 in FIG. 13, may be automatically placed in the cloth 52 in the desired position via cylinder 192, as discussed above with respect to FIG. 12. When plate 54 drops down on cloth 52, also as discussed, the plate 54 holds the label in position for sewing.

Motors 45 and 29, FIG. 3, may be of any suitable type, such as conventional variable speed serv motors coupled to the ball screws 26, 40. Thus, as screws 26, 40 rotate, the nuts 39, 39', coupled to brackets 36, 57, and bracket 18' coupled to apparatus 18 in any suitable manner, move the guide plate 54 along the X and Y axes as heretofore discussed.

Motors 29 and 45 may include suitable tachometers 243, 244, respectively to bring the motors 29, 45 to the proper speed within milliseconds after actuation. A conventional overload slip clutch, such as clutches 245, 246, may be provided at each motor 29, 45, respectively. Clutches 245, 246 are adapted to slip in case of a jam and, thus, save the apparatus and motors from possible damage (See FIG. 3).

As heretofore discussed with respect to FIG. 9, the braces 148, 149 act as guide rings and are separated by spacer ring 150. The rotary guide flange 153 slides between the guide rings 148, 149 with a relatively small clearance, such as about 0.005 inches. This allows for an almost perfect surface alignment between the rotary turntable 51 and the stationary table or top wall 15 as the turntable 51 rotates. Turntable 51 preferably has three guides 153 that slide between rings 148, 149 at the same time spaced about six inches apart. It is necessary that there be substantially perfect surface alignment between stationary table 15 and rotary turntable 51 to allow the cloth 52 and guide plate 54 to move from one table (15 or 51) to the other without any interference.

The chain cutter of sewing machine 13 is of conventional construction and both it and the scrap vacuum 112, 113 therefore can only operate when machine 13 is in its starting position. As turntable 51 and sewing machine 13 make their 360° turn in 90° increments, the scrap and chain cutter vacuum lines (lines 112, 118 and lines 114, 113—FIG. 7) must be disconnected. The excess material cut from cloth 52 while the rotary turntable 51 and sewing machine 13 are turning is collected in the scrap collection tray 106 until turntable 51 and sewing machine 13 return to their starting position. When this starting position is reached, the lines 112, 118 and 113, 114 interconnect, as heretofore discussed, and scrap material in tray 106 is sucked out of the tray 106 to a suitable remote disposal area (not shown) via vacuum hoses 108, 20.

Figure 23:
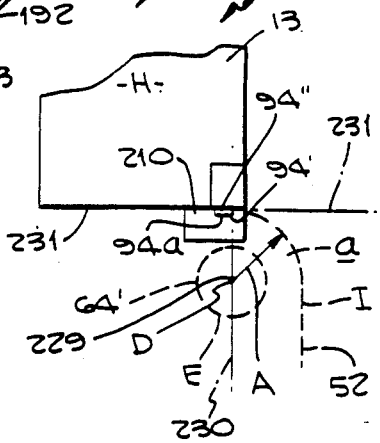
FIG. 23 is a diagrammatic illustration of the sewing features of my invention.

As seen in FIG. 23, it can be seen that the apparatus disclosed herein sews a 90° arc around each corner of cloth 52 as sewing machine 13 rotates. The size of the arc (I) is determined by the radius (A). The axis of the arc (I) is the center (D) of the main shaft 62. To operate properly, the axis (D) must be on line 230 which is even with the leading edge 94' of the cloth cutting blade **94*a* and perpendicular to line 231 and the edge 94" of the cutting blade 94*a*. This allows the cloth to be fed perfectly straight into the cutting edge 94" parallel and even with line 231 as the sewing machine 13** is rotating.

To properly sew the corner arc (I) with no change in the RPMS of machine 13, the sewing machine 13 must be rotated at a speed that would keep the surface speed on needle plate 210 the same as it was on the straight-of-way.

This is accomplished by the quick acting pneumatic turn cylinder 167 (FIG. 4), the speed being regulated as heretofore discussed so that the exact desired surface speed may be obtained on the needle plate 210.

After sewing, the finished sewn cloth is ejected from apparatus 10 via tubes 49, 50 and another cloth is moved into position for stitching and trimming.

My apparatus has wide applications and can be used to quickly and easily sew borders on any desired cloth material, such as towels, napkins, dish cloths, sheets, wash cloths, etc. Although suitable controls have been provided to make the system as automated as possible, and other controls will occur to those familiar in the material handling art, obviously various steps of the operation may be carried out manually or by suitable mechanical means.

Any conventional overlock sewing machine can be used. An overlock machine is a sewing machine that rolls the edge of the cloth and hems the rolled edge while cutting off excess material. A suitable machine that can be used is the Model M-3 DR-2 sewing machine manufactured and sold by The Merrow Machine Co. of Hartford, Conn.

I claim as my invention:

1. In a method for forming a stitch about the periphery of a generally rectangular piece of cloth material having rounded corners using an overlock sewing machine having means for selectively hemming, stitching and cutting off excess material from a sewn piece of cloth, the method comprising the steps of:

moving said piece of cloth material along a first axis into operative engagement with said sewing machine at a predetermined surface speed;

hemming, stitching and trimming along one elongated side of said piece of cloth material thereby forming a first stitched row until said sewing machine is adjacent one of the rounded corners of said piece of cloth material;

stopping the movement of said piece of cloth material when said piece is adjacent said corner; and subsequently turning the sewing machine while stitching and at said surface speed thereby stitching a rounded row of stitching at said corner.

2. In the method of claim 1 including the step of subsequently stopping the turning of said sewing machine when said corner is stitched, continuing movement of said piece at said surface speed in a direction normal to said first axis while operating said machine to thereby form a second stitched row of stitching extending normal to said first stitched row of stitching, stopping the movement of said piece in said direction normal to said first axis when a second corner is reached, turning said sewing machine about said second corner at said surface speed while stitching to thereby form a second rounded stitched corner, stopping the turning of said machine when said second corner is stitched, continuing movement of said piece at said surface speed in a direction parallel to said first axis while operating said machine to thereby form a third stitched row of stitching extending parallel to said first stitched row of stitching, stopping the movement of said piece in said direction parallel to said first axis when a third corner is reached, turning said sewing machine about said third corner at said surface speed while stitching to thereby form a third rounded stitched corner stopping the turning of said machine when said third corner is stitched, continuing movement of said piece at said surface speed in a direction normal to said first axis while operating said machine to thereby form a fourth stitched row of stitching extending normal to said first stitched row of stitching, stopping the movement of said piece in said direction normal to said first axis when a fourth corner is reached, turning said sewing machine about said fourth corner at said surface speed while stitching to thereby form a fourth rounded stitched corner slightly overlapping said first stitched row.

3. In the method of claim 2 including the step of moving said stitched cloth to tension threads connected thereto, then slacken the tensioned threads and cutting off the same.

* * * * *